US011470707B1

(12) United States Patent
Zhao et al.

(10) Patent No.: US 11,470,707 B1
(45) Date of Patent: Oct. 11, 2022

(54) LED DRIVING SYSTEM WITH COMMUNICATION BETWEEN MULTIPLE INTEGRATED CIRCUITS

(71) Applicant: Monolithic Power Systems, Inc., San Jose, CA (US)

(72) Inventors: Junjian Zhao, San Jose, CA (US); Chia-Lung Ni, New Taipei (TW); Zheng Luo, San Jose, CA (US); Yu-Huei Lee, New Taipei (TW); Huan Liu, Chengdu (CN)

(73) Assignee: Monolithic Power Systems, Inc., San Jose, CA (US)

( * ) Notice: Subject to any disclaimer, the term of this patent is extended or adjusted under 35 U.S.C. 154(b) by 35 days.

(21) Appl. No.: 17/330,575

(22) Filed: May 26, 2021

(51) Int. Cl.

| | |
|---|---|
| ***H05B 47/155*** | (2020.01) |
| ***H05B 45/35*** | (2020.01) |
| ***F21V 23/00*** | (2015.01) |
| ***H05B 45/46*** | (2020.01) |
| ***H05B 45/32*** | (2020.01) |
| ***H05B 45/325*** | (2020.01) |
| *F21Y 115/10* | (2016.01) |

(52) U.S. Cl.
CPC ..... *H05B 47/155* (2020.01); *F21V 23/005* (2013.01); *H05B 45/32* (2020.01); *H05B 45/325* (2020.01); *H05B 45/35* (2020.01); *H05B 45/46* (2020.01); *F21Y 2115/10* (2016.08)

(58) Field of Classification Search
CPC ..... F21V 23/005; H05B 45/35; H05B 45/32; H05B 45/325; H05B 45/46; H05B 47/155
See application file for complete search history.

(56) References Cited

U.S. PATENT DOCUMENTS

| | | | | |
|---|---|---|---|---|
| 5,969,479 | A * | 10/1999 | Wong | A43B 3/36 36/137 |
| 10,270,343 | B2 | 4/2019 | Nguyen et al. | |
| 2013/0009568 | A1 * | 1/2013 | Yu | H02M 3/33561 315/297 |

* cited by examiner

*Primary Examiner* — Elmito Breval
*Assistant Examiner* — Nathaniel J Lee
(74) *Attorney, Agent, or Firm* — Perkins Coie LLP

(57) ABSTRACT

An LED driving system for synchronizing two LED driving integrated circuits to drive LED strings. The LED driving system sequentially activates the LED strings driven by the first LED driving integrated circuit and then outputs a downstream enabling signal from the first LED driving integrated circuit to the second LED driving integrated circuit to activate the LED strings driven by the second LED driving integrated circuit.

20 Claims, 4 Drawing Sheets

LED DRIVING SYSTEM WITH COMMUNICATION BETWEEN MULTIPLE INTEGRATED CIRCUITS

FIELD OF THE INVENTION

The present invention relates generally to electronic circuits, and more particularly but not exclusively to LED (Light Emitting Diode) driving circuits.

BACKGROUND OF THE INVENTION

Nowadays, Light Emitting Diode (LED) sequential lighting has been used on the rear end of vehicles for both aesthetics and functionality. A large number of LED strings are sequentially lit on in the LED sequential lighting. Due to the limit of the number of LED strings that a typical LED driving integrated circuit can drive, more than one LED driving integrated circuits are usually needed to drive the demanded number of LED strings. Thus, how to synchronize the time delay between the time at which the last LED string driven by an LED driving integrated circuit is lit on and the time at which the first LED string driven by a next LED driving integrated circuit is lit on needs to be addressed.

SUMMARY

Embodiments of the present invention are directed to an LED driving integrated circuit for driving a plurality of LED strings, the LED driving integrated circuit comprising: an enabling pin configured to receive an enable signal; a plurality of LED enabling circuits having a one-to-one correspondence with the plurality of LED strings, wherein each LED enabling circuit is coupled to a corresponding LED string and is configured to activate the corresponding LED string when the LED enabling circuit is enabled; a downstream enabling circuit configured to provide a downstream enabling signal, wherein the downstream enabling signal is asserted when the downstream enabling circuit is enabled; a controlling circuit coupled to the enabling pin to receive the enable signal, wherein in response to the enable signal, the controlling circuit sequentially enables the plurality of LED enabling circuits and enables the downstream enabling circuit after the plurality of LED enabling circuits are enabled; and a downstream enabling pin coupled to the downstream enabling circuit and configured to output the downstream enabling signal.

Embodiments of the present invention are also directed to an driving circuit for driving a plurality of LED strings, the LED driving integrated circuit comprising: an enabling pin for receiving an enable signal; a controlling circuit coupled to the first pin to receive the enable signal and configured to generate a plurality of LED enabling control signals and a downstream enabling control signal based on the enable signal; a plurality of LED enabling circuits having a one-to-one correspondence with the plurality of LED strings and with the plurality of LED enabling control signals, wherein each LED enabling circuit is coupled to the controlling circuit to receive a corresponding LED enabling control signal, and wherein each LED enabling circuit is coupled to a corresponding LED string and is configured to activate or deactivate the corresponding LED string in response to the corresponding LED enabling control signal; a downstream enabling switch coupled to the controlling circuit to receive the downstream enabling control signal and configured to provide a downstream enabling signal based on the downstream enabling control signal; and a downstream enabling pin coupled to the downstream enabling switch and configured to output the downstream enabling control signal.

Embodiments of the present invention are further directed to an LED driving system, comprising: a first LED driving integrated circuit and a second LED driving integrated circuit with each comprising an LED driving integrated circuit configured to drive a plurality of LED strings, wherein the LED driving integrated circuit comprises: an enabling pin configured to receive an enable signal; a plurality of LED enabling circuits having a one-to-one correspondence with the plurality of LED strings, wherein each LED enabling circuit is coupled to a corresponding LED string and is configured to activate the corresponding LED string when the LED enabling circuit is enabled; a downstream enabling circuit configured to provide a downstream enabling signal, wherein the downstream enabling signal is asserted when the downstream enabling circuit is enabled; a controlling circuit coupled to the enabling pin to receive the enable signal, wherein in response to the enable signal, the controlling circuit sequentially enables the plurality of LED enabling circuits and enables the downstream enabling circuit after the plurality of LED enabling circuits are enabled; and a downstream enabling pin coupled to the downstream enabling circuit and configured to output the downstream enabling signal; wherein the enabling pin of the second LED driving integrated circuit is coupled to the downstream enabling pin of the first LED driving integrated circuit.

DESCRIPTION OF THE DRAWINGS

The present invention can be further understood with reference to the following detailed description and the appended drawings, wherein like elements are provided with like reference numerals.

DESCRIPTION

Figure 1:
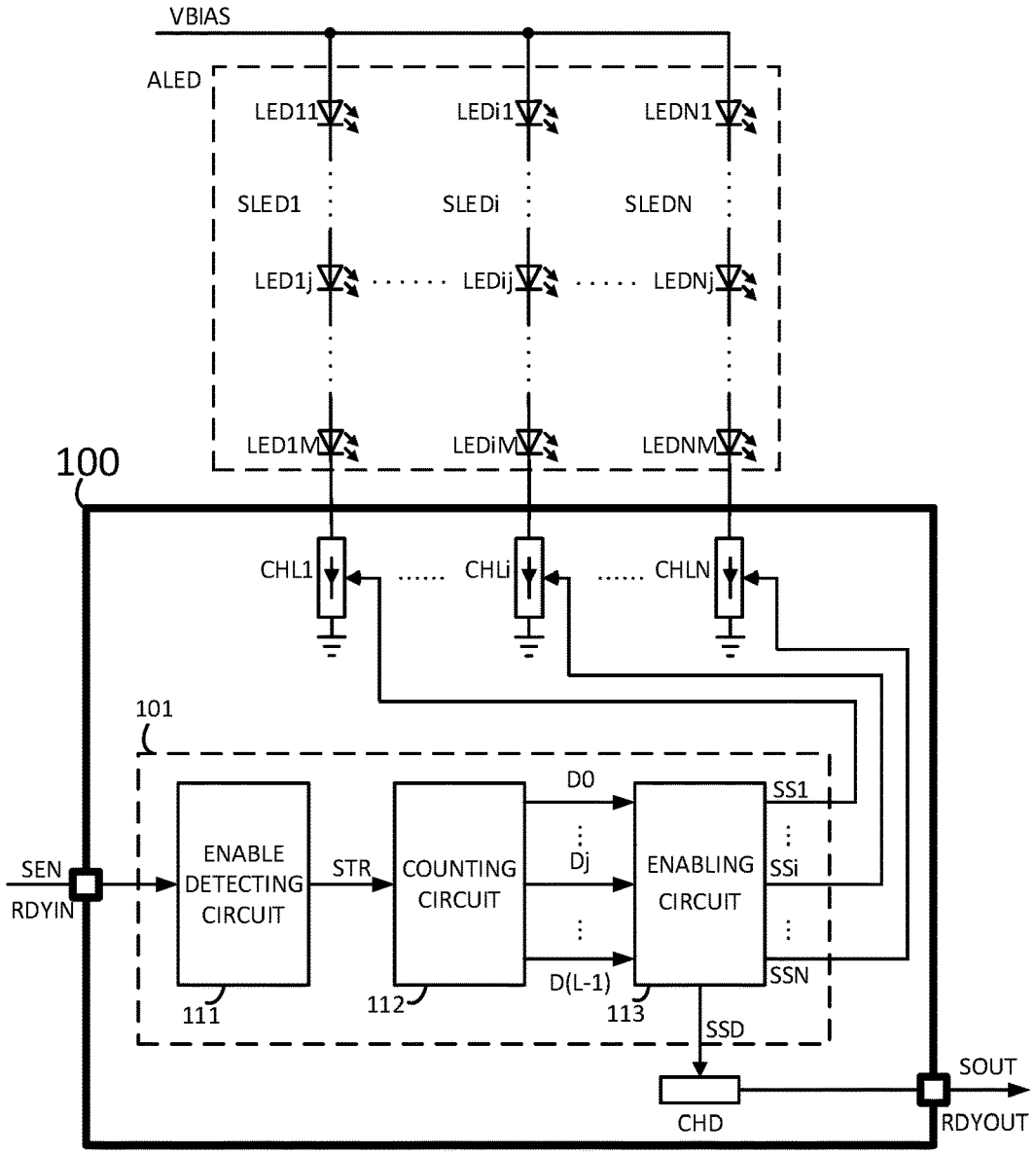
FIG. 1 schematically illustrates an LED driving integrated circuit 100 in accordance with an embodiment of the present invention.

The present invention is now described. While it is disclosed in its preferred form, the specific embodiments of the invention as disclosed herein and illustrated in the drawings are not to be considered in a limiting sense. Rather, these embodiments are provided so that this invention will be thorough and complete, and will fully convey the scope of the invention to those skilled in the art. Indeed, it should be readily apparent in view of the present description that the invention may be modified in numerous ways. Among other things, the present invention may be embodied as devices, methods, software, and so on. Accordingly, the present invention may take the form of an entirely hardware embodiment, an entirely software embodiment or an embodiment combining software and hardware aspects. The following detailed description is, therefore, not to be taken in a limiting sense.

Throughout the invention, the plural forms "a plurality of" and "the plurality of" do not exclude singular reference unless the context clearly dictates otherwise. For example, the term "a plurality of LED strings" or "the plurality of LED strings" may include only one LED string. For another example, the term "a plurality of LEDs" or "the plurality of LEDs" may include only one LED. In addition, throughout the invention, the meaning of "a," "an," and "the" may also include plural references.

FIG. 1 schematically illustrates an LED driving integrated circuit 100 in accordance with an embodiment of the present invention. As shown in FIG. 1, the Light Emitting Diode (LED) driving integrated circuit 100 is configured to drive an LED array ALED. The LED array ALED comprises a plurality of LED strings SLED1 . . . SLEDi . . . SLEDN, wherein i represents an integer in the range of 1 to N and N represents an integer greater than or equal to 1. And the LED string SLEDi (i=1, 2 . . . or N) comprises a plurality of LEDs LEDi1 . . . LEDij . . . LEDiM with each LED having a first terminal (e.g. anode) and a second terminal (e.g. cathode), wherein j represents an integer in the range of 1 to M and M represents an integer greater than or equal to 1. The first terminals of the LEDs LEDi2 . . . LEDiM are coupled to the second terminals of the LEDs LEDi1 . . . LEDi(M−1) in a one-to-one correspondence fashion as shown, the first terminal of the LEDi1 is configured to receive a bias voltage VBIAS as an input power supply.

As shown in FIG. 1, the LED driving integrated circuit 100 is configured to comprise an enabling pin RDYIN configured to receive an enable signal SEN and a downstream enabling pin RDYOUT. The LED driving integrated circuit 100 is further configured to comprise a plurality of LED enabling circuits CHL1 . . . CHLi . . . CHLN having a one-to-one correspondence with the plurality of LED strings SLED1 . . . SLEDi . . . SLEDN. More specifically, the LED enabling circuit CHLi is coupled to the LED string SLEDi and is configured to activate the LED string SLEDi when the LED enabling circuit CHLi is enabled or to deactivate the LED string SLEDi when the LED enabling circuit CHLi is disabled.

In an embodiment, to "activate" an LED string means to permit sufficient current to flow through the LED string such that the LED string is lit on to output light, conversely, to "deactivate" an LED string means to inhibit sufficient current to flow through the LED string such that the LED string is not lit on and no light is output.

In an embodiment, when the LED enabling circuit CHLi is "enabled", an electrical path is established to permit sufficient current to flow through the LED enabling circuit CHLi and thus the LED string SLEDi. Conversely, when the LED enabling circuit CHLi is "disabled", no electrical path is established to permit sufficient current to flow through the LED enabling circuit CHLi and the LED string SLEDi.

Figure 4:
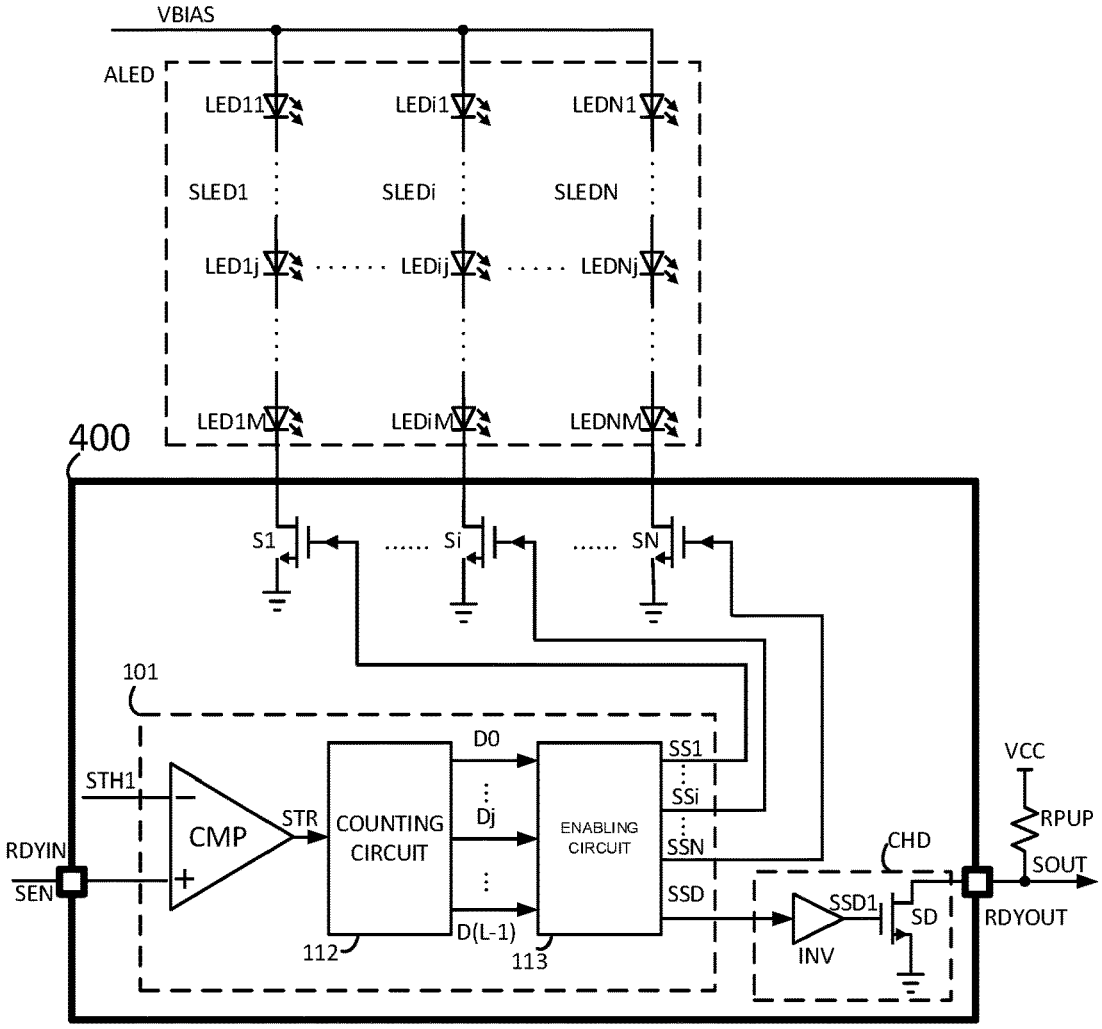
FIG. 4 schematically illustrates an LED driving integrated circuit 400 in accordance with an embodiment of the present invention.

In an embodiment, the LED enabling circuit CHLi (i=1, 2, . . . , or N) comprises an LED enabling switch Si as shown in FIG. 4. The LED enabling switch Si has a first terminal, a second terminal and a control terminal. The first terminal of the LED enabling switch S1 is coupled to the second terminal of the corresponding LED string SLEDi and the second terminal of the LED enabling switch S1 is coupled to a reference ground (e.g., via a resistor). The LED enabling switch S1 is configured to receive an LED enabling control signal SSi at the control terminal and the LED enabling switch Si is selectively turned on ("enabled") or turned off ("disabled") in response to the LED enabling control signal SSi. More specifically, the LED enabling switch Si is turned on when the LED enabling control signal SSi is in an active state (e.g., logic "1") and is turned off when the LED enabling control signal SSi is in a non-active state (e.g., logic "0"). In one embodiment, the LED enabling switch Si may be implemented with a metal oxide semiconductor field effect transistor (MOSFET). In further another embodiment, the MOSFET may be an N-type MOSFET.

As shown in FIG. 1, the LED driving integrated circuit 100 is configured to further comprise a downstream enabling circuit CHD configured to provide a downstream enabling signal SOUT. The downstream enabling signal SOUT is asserted (e.g., logic "1") when the downstream enabling circuit CHD is enabled and de-asserted (e.g., logic "0") when the downstream enabling circuit CHD is disabled. The downstream enabling pin RDYOUT is coupled to the downstream enabling circuit CHD and is configured to output the downstream enabling signal SOUT.

In an embodiment, the enable signal SEN represents operational information for sequentially activating the plurality of LED strings SLED1 . . . SLEDi . . . SLEDN. For example, in an automotive application, the enable signal SEN may represent a user command of turning on the rear lights in a sequential fashion.

In an embodiment, the downstream enabling circuit CHD comprises an inverter INV and a downstream enabling switch SD as shown in FIG. 4. The inverter INV has an input terminal and an output terminal. The input terminal of the inverter INV is coupled to the enabling circuit 113 to receive a downstream enabling control signal SSD and the inverter INV inverts the downstream enabling control signal SSD and outputs an inverted downstream enabling control signal SSD1 of at the output terminal of the inverter INV. The downstream enabling switch SD has a first terminal, a second terminal and a control terminal. The first terminal of the downstream enabling switch SD is coupled to a supply voltage VCC and is configured to provide the downstream enabling signal SOUT. In an embodiment as shown in FIG. 4, the first terminal of the downstream enabling switch SD is coupled to a supply voltage VCC via a resistor RPUP. The second terminal of the downstream enabling switch SD is coupled to a reference ground. The downstream enabling switch D is configured to receive the inverted downstream enabling control signal SSD1 at the control terminal and the downstream enabling switch SD is selectively turned on ("enabled") or turned off ("disabled") in response to the downstream enabling control signal SSD (or the inverted downstream enabling control signal SSD1). More specifically, the downstream enabling switch SD is turned off when the downstream enabling control signal SSD is in an active state (e.g., logic "1") and the inverted downstream enabling control signal SSD1 is in a non-active state (e.g., logic "0"). And thus, the downstream enabling signal SOUT is in a high voltage level and is asserted. On the other side, the downstream enabling switch SD is turned on when the downstream enabling control signal SSD is in a non-active state (e.g., logic "0") and the inverted downstream enabling control signal SSD1 is in an active state (e.g., logic "1"). And thus, the downstream enabling signal SOUT is in a low voltage level and is de-asserted. In an embodiment, the downstream enabling switch SD is an N-type MOSFET.

Figure 7:
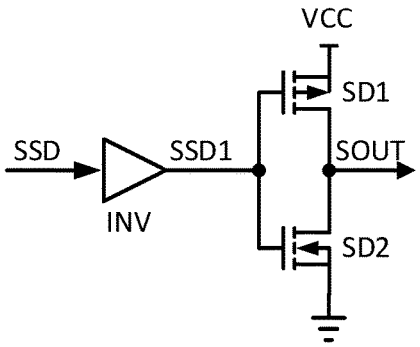
FIG. 7 schematically illustrates another downstream enabling circuit in accordance with an embodiment of the present invention.

In another embodiment, as shown in FIG. 7, the downstream enabling circuit CHD may comprise an inverter INV, a first downstream enabling switch SD1 and a second downstream enabling switch SD2. The inverter INV has an input terminal and an output terminal. The input terminal of the inverter INV is coupled to the enabling circuit 113 to receive a downstream enabling control signal SSD and the inverter INV inverts the downstream enabling control signal SSD and outputs an inverted downstream enabling control signal SSD1 of at the output terminal of the inverter INV. Both the first downstream enabling switch SD1 and the second downstream enabling switch SD2 have a first terminal, a second terminal and a control terminal. The first terminal of the first downstream enabling switch SD1 is coupled to a supply voltage VCC, the first terminal of the second downstream enabling switch SD2 is coupled to the second terminal of the first downstream enabling switch SD1 and is configured to provide the downstream enabling signal SOUT, and the second terminal of the second downstream enabling switch SD2 is coupled to a reference ground. Both the first downstream enabling switch SD1 and the second downstream enabling switch SD2 are configured to receive the inverted downstream enabling control signal SSD1 respectively at their control terminals and the first downstream enabling switch SD1 and the second downstream enabling switch SD2 are selectively turned on ("enabled") or turned off ("disabled") in response to the downstream enabling control signal SSD (or the inverted downstream enabling control signal SSD1). More specifically, the first downstream enabling switch SD1 is turned on and the second downstream enabling switch SD2 is turned off when the downstream enabling control signal SSD is in an active state (e.g., logic "1") and the inverted downstream enabling control signal SSD1 is in a non-active state (e.g., logic "0"). And thus, the downstream enabling signal SOUT is in a high voltage level and is asserted. On the other side, the first downstream enabling switch SD1 is turned off and the second downstream enabling switch SD2 is turned on when the downstream enabling control signal SSD is in a non-active state (e.g., logic "0") and the inverted downstream enabling control signal SSD1 is in an active state (e.g., logic "1"). And thus, the downstream enabling signal SOUT is in a low voltage level and is de-asserted. In an embodiment, the first downstream enabling switch SD1 is a P-type MOSFET and the second downstream enabling switch SD2 is a N-type MOSFET.

Figure 3:
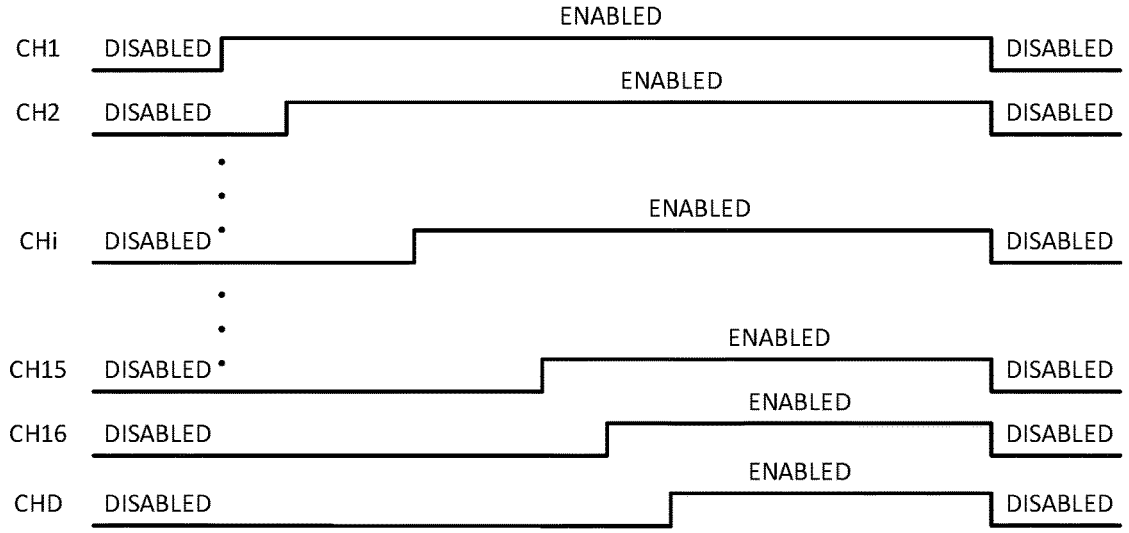
FIG. 3 illustrates the waveforms of an exemplary enabling circuit 113W in accordance with an embodiment of the present invention.

Further referring to FIG. 1, the LED driving integrated circuit 100 is configured to further comprise a controlling circuit 101 coupled to the enabling pin RDYIN to receive the enable signal SEN. In response to the enable signal SEN, the controlling circuit 101 is configured to generate a plurality of LED enabling control signals SS1 . . . SSi . . . SSN and a downstream enabling control signal SSD. The controlling circuit 101 is configured to sequentially enable the plurality of LED enabling circuits CHL1 . . . CHLi CHLN with the plurality of LED enabling control signals SS1 . . . SSi . . . SSN and to enable the downstream enabling circuit CHD with the downstream enabling control signal SSD. In an embodiment, the downstream enabling circuit CHD is enabled after the plurality of LED enabling circuits CHL1 . . . CHLi . . . CHLN are enabled, as shown in FIG. 3. That is, the controlling circuit 101 enables the LED enabling circuit CHL1, the LED enabling circuit CHL2, . . . , all the way to the LED enabling circuit CHLN, and afterwards, the controlling circuit 101 enables the downstream enabling circuit CHD.

In an embodiment, as also shown in FIG. 3, the controlling circuit 101 initiates the sequential enabling operation of the plurality of LED enabling circuits CHL1 . . . CHLi . . . CHLN and the downstream enabling circuit CHD in response to an asserted state of the enable signal SEN. In an embodiment, after the enable signal SEN transits into its asserted state, the controlling circuit 101 initiates the sequential enabling operation. In further an embodiment, after the enable signal SEN transits into its asserted state, the controlling circuit 101 initiates the sequential enabling operation when one or more other conditions are satisfied.

In an embodiment, the controlling circuit 101 enables the plurality of LED enabling circuits CHL1 . . . CHLi . . . CHLN and the downstream enabling circuit CHD at a plurality of enabling times t1 . . . ti . . . tN and tD with a preset time interval td between every two successive enabling times. That is, the controlling circuit 101 enables the plurality of LED enabling circuits CHL1 . . . CHLi . . . CHLN respectively at the plurality of enabling times t1 . . . ti . . . tN having a one-to-one correspondence with the plurality of LED enabling circuits CHL1 . . . CHLi . . . CHLN and further enables the downstream enabling circuit CHD at the enabling time tD. And in addition, there exits the preset time interval td between every two successive enabling times of the plurality of enabling times t1 . . . ti . . . tN, and also, there exits the preset time interval td between the enabling time tN for enabling the LED enabling circuit CHLN and the enabling time tD for enabling the downstream enabling circuit CHD.

Persons of ordinary skill in the art will recognize that, in the above embodiment, the preset time intervals between every two successive enabling times of the plurality of enabling times t1 . . . ti . . . tN are all equal and are also equal to the preset time interval between the enabling time tN and the enabling time tD, yet in another embodiment, the preset time interval between the enabling time tN and the enabling time tD and the preset time intervals between every two successive enabling times of the plurality of enabling times t1 . . . ti . . . tN may be the same as or different from one another.

Now still referring to FIG. 1, the controlling circuit 101 is configured to comprise an enable detecting circuit 111, a counting circuit 112 and an enabling circuit 113. The enable detecting circuit 111 is configured to receive the enable signal SEN and an enable threshold signal STH1 and to generate a triggering signal STR based on comparing the enable signal SEN with the enable threshold signal STH1.

Figure 2:
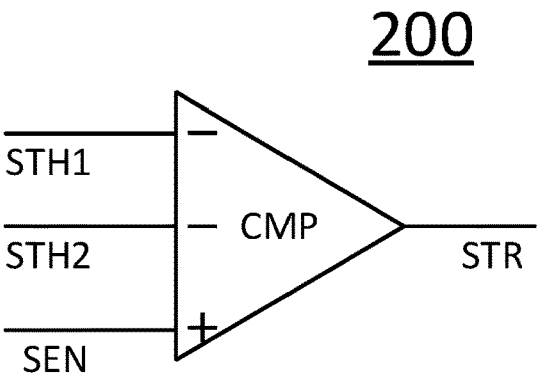
FIG. 2 schematically illustrates an enable detecting circuit 200 in according with an embodiment of the present invention.

FIG. 2 schematically illustrates an enable detecting circuit 200 in according with an embodiment of the present invention. The enable detecting circuit 200 comprises a comparator CMP having a first input terminal, a second input terminal and an output terminal, wherein the first input terminal is configured to receive the enable signal SEN, the second input terminal is configured to receive the enable threshold signal STH1. In one embodiment, the first input terminal of the comparator CMP is a non-inverting input terminal and the second input terminal of the comparator CMP is an inverting input terminal. The comparator CMP compares the enable signal SEN with the enable threshold signal STH1 and generates a triggering signal STR at the output terminal based on the comparison, wherein the triggering signal STR is in an active state (e.g., logic "1") when the enable signal SEN is higher than the enable threshold signal STH1, and the triggering signal STR is in a non-active state (e.g., logic "0") when the enable signal SEN is not higher than the enable threshold signal STH1.

In another embodiment, the comparator CMP may further comprise a third input terminal configured to receive another enable threshold signal STH2, in such the embodiment, the comparator CMP compares the enable signal SEN with the enable threshold signals STH1 and STH2 and generates the triggering signal STR at the output terminal based on the comparison, wherein the triggering signal STR is in an active state (e.g., logic "1") when the enable signal SEN is higher than the enable threshold signal STH1, and the triggering signal STR is in a non-active state (e.g., logic "0") when the enable signal SEN is lower than the enable threshold signal STH2.

The counting circuit 112 is configured to receive the triggering signal STR and to generate a counting signal SCT having a counting value, wherein the counting circuit 112 is configured to increment the counting value every a preset time interval td in response to an active state (e.g., logic "1") of the triggering signal STR. That is, the counting circuit 112 is configured to increment the counting value every a preset time interval td after the triggering signal STR transits into the active state.

In an embodiment, the counting circuit 112 is configured to receive a clock signal CLK having a clock cycle equal to the preset time interval td and the counting circuit 112 is configured to increment the counting value in response to each cycle of the clock signal CLK. In further an embodiment, the clock signal CLK has a plurality of rising edges generated when the clock signal CLK transits from a non-active state (e.g., logic "0") into an active state (e.g., logic "1"), and there exists the preset time interval td between every two successive rising edges. In such the embodiment, the counting circuit 112 increments the counting value in response to each rising edge of the clock signal CLK. In another embodiment, the counting circuit 112 increments the counting value from an initial counting value L0 and to a preset maximum counting value LM.

Table 1 illustrates the operation of an exemplary counting circuit 112T in accordance with an embodiment of the present invention. The counting circuit 112T can be implemented as the counting circuit 112 of FIG. 1. The counting circuit 112T is configured to receive the triggering signal STR and the clock signal CLK, and based on the triggering signal STR and the clock signal CLK, the counting circuit 112T outputs a counting signal SCT having a counting value represented by L sequential digital bits D[L−1] . . . D[0] as shown in Table 1, wherein L is an integer greater than 0. More specifically, when the triggering signal STR is in the non-active state (e.g., logic "0"), the counting value of the counting signal SCT is at the initial value L0, and after the triggering signal STR transits from the non-active state (e.g., logic "0") to the active state (e.g., logic "1"), the counting circuit 112T increments one at each rising edge of the clock signal CLK from the initial counting value L0 and to the preset maximum counting value LM. Taking L=4 for example, as shown in Table 1, the counting circuit 112T has 64 states S1 . . . S64. Supposing the counting circuit 112T has an initial counting value 00000 when the triggering signal STR is in the non-active state (e.g., logic "0"), the counting circuit 112T increments the counting value from the initial counting value 00000 to 00001 when the first rising edge of the clock signal CLK arrives after the triggering signal STR transits into the active state (e.g., logic "1"). And similarly, the counting circuit 112T then increments the counting value from 00001 to 00010 when the next rising edge of the clock signal CLK arrives. The counting circuit 112T repeats the above operation until the preset maximum counting value LM is reached. In one embodiment, the preset maximum counting value LM may be determined by the number of the plurality of LED strings. For example, the preset maximum counting value LM can be set to 10001 when the LED driving integrated circuit 100 drives 16 LED strings. In another embodiment, the number of the digital bits L is such selected so that 2≥LM.

TABLE 1

| State | D[4] | D[3] | D[2] | D[1] | D[0] |
|---|---|---|---|---|---|
| S1 | 0 | 0 | 0 | 0 | 0 |
| S2 | 0 | 0 | 0 | 0 | 1 |
| S3 | 0 | 0 | 0 | 1 | 0 |
| S4 | 0 | 0 | 0 | 1 | 1 |
| S5 | 0 | 0 | 1 | 0 | 0 |
| S6 | 0 | 0 | 1 | 0 | 1 |
| S7 | 0 | 0 | 1 | 1 | 0 |
| S8 | 0 | 0 | 1 | 1 | 1 |
| S9 | 0 | 1 | 0 | 0 | 0 |
| S10 | 0 | 1 | 0 | 0 | 1 |
| S11 | 0 | 1 | 0 | 1 | 0 |
| S12 | 0 | 1 | 0 | 1 | 1 |
| S13 | 0 | 1 | 1 | 0 | 0 |
| S14 | 0 | 1 | 1 | 0 | 1 |
| S15 | 0 | 1 | 1 | 1 | 0 |
| S16 | 0 | 1 | 1 | 1 | 1 |
| S17 | 1 | 0 | 0 | 0 | 0 |
| S18 | 1 | 0 | 0 | 0 | 1 |
| . . . | . . . | . . . | . . . | . . . | . . . |
| S64 | 1 | 1 | 1 | 1 | 1 |

The enabling circuit 113 is configured to generate a plurality of LED enabling control signals SS1 . . . SSi . . . SSN and a downstream enabling control signal SOUT based on the counting signal SCT, wherein the plurality of LED enabling control signals SS1 . . . SSi . . . SSN have a one-to-one correspondence with the plurality of LED enabling circuits CHL1 . . . CHLi CHLN and are respectively configured to selectively enable or disable the plurality of LED enabling circuits CHL1 . . . CHL i . . . CHLN, and the downstream enabling circuit SOUT is configured to selectively enable or disable the downstream enabling circuit CHD. More specifically, the LED enabling circuit CHLi is enabled when the corresponding LED enabling control signal SSi is in its active state (e.g., logic "1"), and the LED enabling circuit CHLi is disabled when the corresponding LED enabling control signal SSi is in its non-active state (e.g., logic "0"). Similarly, the downstream enabling circuit CHD is enabled when the downstream enabling control signal SOUT is in its active state (e.g., logic "1"), and the downstream enabling circuit CHD is disabled when the downstream enabling control signal SOUT is in its non-active state (e.g., logic "0").

FIG. 3 illustrates the waveforms of an exemplary enabling circuit 113W in accordance with an embodiment of the present invention. The enabling circuit 113W can be implemented as the enabling circuit 113 of FIG. 1. For the purpose of ease, the below description of the operation of the enabling circuit 113 will be set forth on the assumption that the LED driving integrated circuit 100 is configured to drive 16 LED enabling circuits. The enabling circuit 113W is configured to convert the counting signal SCT of the digital form into the plurality of LED enabling control signals SS1 SSi SSN of an analog form and into the downstream enabling control signal SSD of an analog form. Specifically, the enabling circuit 113W is configured to receive the counting signal SCT, and when the counting value of the counting signal SCT transits from 00000 to 00001, the LED enabling control signal SS1 transits from the non-active state (e.g., logic "0") into the active state (e.g., logic "1") to enable the LED enabling circuit CHL1. Similarly, when the counting value of the counting signal SCT transits from 00001 to 00010, the LED enabling control signal SS2 transits from the non-active state (e.g., logic "0") into the active state (e.g., logic "1") to enable the LED enabling circuit CHL2. The enabling circuit 113W repeats the above operation until the LED enabling circuit CHL16 is enabled when the counting value of the counting signal SCT transits from 01111 to 10000. Afterwards, the downstream enabling control signal SSD transits from the non-active state (e.g., logic "0") into the active state (e.g., logic "1") to enable the downstream enabling circuit CHD when the counting value of the counting signal SCT transits from 10000 to 10001.

FIG. 4 schematically illustrates an LED driving integrated circuit 400 in accordance with an embodiment of the present invention. In the LED driving integrated circuit 400, the enable detecting circuit is implemented with the comparator CMP illustrated in FIG. 2, the counting circuit is implemented with the counting circuit 112T described above, the enabling circuit is implemented with the enabling circuit 113W, the LED enabling circuit CHLi (i=1, 2, . . . , or N) is implemented with an LED enabling switch Si, and the downstream enabling circuit CHD is implemented with an inverter INV and a downstream enabling switch SD.

Figure 5:
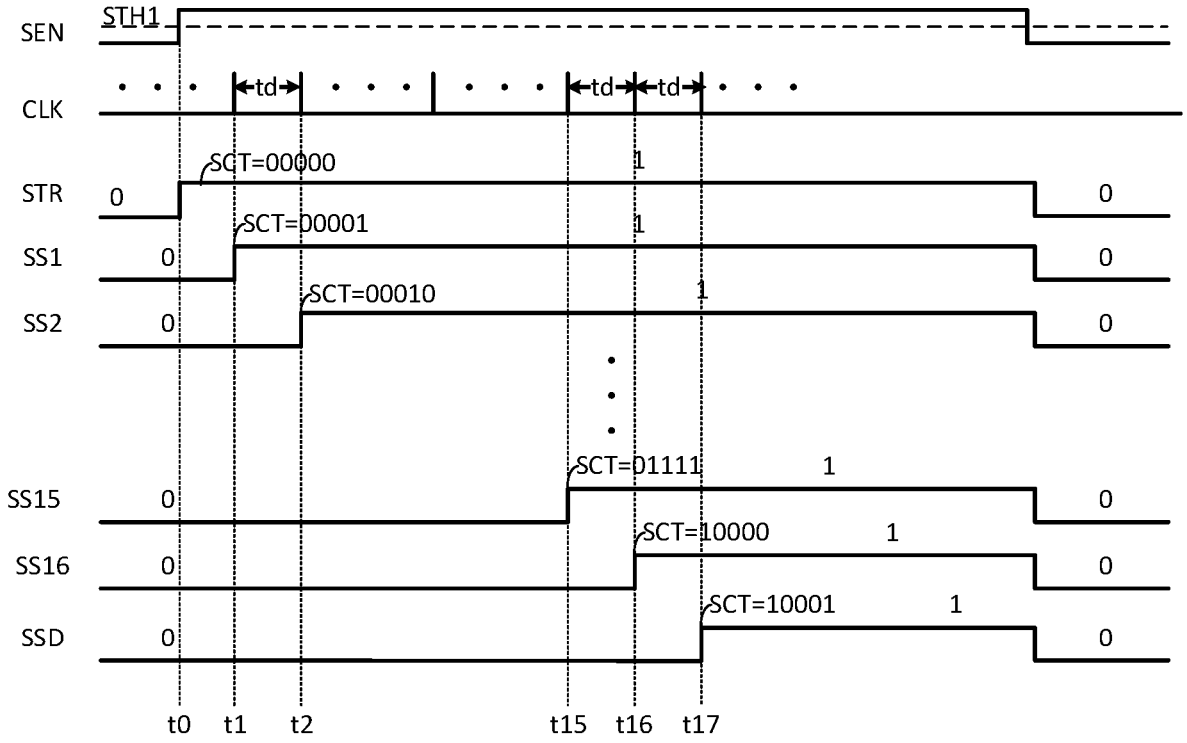
FIG. 5 shows some waveforms of the LED driving integrated circuit 400.

FIG. 5 shows some waveforms of the LED driving integrated circuit 400. Next, the operation of the LED driving integrated circuit 400 will be elaborated with reference to FIG. 5. For the purpose of ease, the below description of the operation of the LED driving integrated circuit 400 will be set forth on the assumption that the LED driving integrated circuit 400 is configured to drive 16 LED enabling circuits. When the enable signal SEN is higher than the enable threshold signal STH1 (e.g., 2V), the triggering signal STR from the compactor CMP transits into an active state (e.g., logic "1") at time t0, which makes the counting circuit 112 start counting by incrementing the counting value of the counting signal SCT from an initial value (e.g., 00000 as shown in FIG. 5). As shown in FIG. 5, when a first rising edge of the clock signal CLK arrives at time t1 after the triggering signal STR transits into the active state, the counting signal SCT increments from 00000 to 00001, which makes the LED enabling control signal SS1 from the enabling circuit 113 active (e.g., logic "1"). As a result, the corresponding LED string SLED1 is activated as the LED enabling switch S1 is turned on by the active LED enabling control signal SS1. Subsequently, after a preset time interval td, a second rising edge of the clock signal CLK arrives at time t2, which makes the counting signal SCT increment from 00001 to 00010, thus making the LED enabling control signal SS2 from the enabling circuit 113 active (e.g., logic "1"). Such active LED enabling control signal SS2 turns on the LED enabling switch S2, thus activating the corresponding LED string SLED2. The above operation repeats until the last LED string SLED16 is activated at time t16 when the counting signal SCT increments from 01111 to 10000 and the LED enabling control signal SS16 thus transits into an active state (e.g., logic "1").

Afterwards, when the next rising edge of the clock signal CLK arrives at time t17, the counting signal SCT increments from 10000 to 10001, which makes the downstream enabling control signal SSD from the enabling circuit 113 active (e.g., logic "1") and the inverted downstream enabling control signal SSD1 from the inverter INV non-active (e.g., logic "0"). As a result, the downstream enabling switch SD is turned off by the non-active inverted downstream enabling control signal SSD1, which makes the downstream enabling signal SOUT be at a high voltage level and be asserted (e.g., logic "1").

Figure 6:
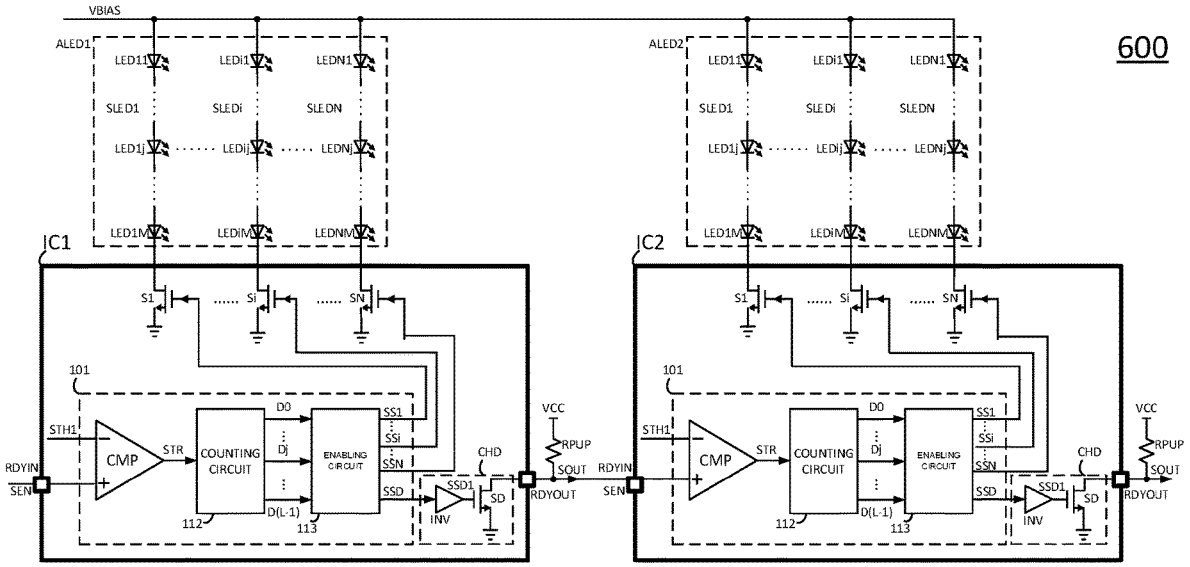
FIG. 6 illustrates an LED driving system 600 in accordance with an embodiment of the present invention.

FIG. 6 illustrates an LED driving system 600 in accordance with an embodiment of the present invention. The LED driving system 600 is configured to comprise a first LED driving integrated circuit IC1 and a second LED driving integrated circuit IC2. The first LED driving integrated circuit IC1 is configured to drive an LED array ALED1 having a configuration as that of the LED array ALED as shown in FIG. 1. The second LED driving integrated circuit IC2 is configured to drive an LED array ALED2 having a configuration as that of the LED array ALED as shown in FIG. 1. The first LED driving integrated circuit IC1 and the second LED driving integrated circuit IC2 both comprise an LED driving integrated circuit described in the above embodiments. The enabling pin RDYIN of the second LED driving integrated circuit IC2 is coupled to the downstream enabling pin RDYOUT of the first LED driving integrated circuit IC1 to receive the downstream enabling signal SOUT from the first LED driving integrated circuit IC1 as the enable signal SEN of the second LED driving integrated circuit IC2.

Next, the operation of the LED driving system 600 with the LED driving integrated circuit 400 as shown in the embodiment of FIG. 4. When the enable signal SEN received by the first LED driving integrated circuit IC1 is higher than the enable threshold signal STH1 (e.g., 2V), the triggering signal STR from the compactor CMP transits into an active state (e.g., logic "1") at time t0, which makes the counting circuit 112 start counting by incrementing the counting value of the counting signal SCT from an initial value (e.g., 00000 as shown in FIG. 5). As shown in FIG. 5, when a first rising edge of the clock signal CLK arrives at time t1 after the triggering signal STR transits into the active state, the counting signal SCT increments from 00000 to 00001, which makes the LED enabling control signal SS1 from the enabling circuit 113 active (e.g., logic "1"). As a result, the corresponding LED string SLED1 is activated as the LED enabling switch S1 is turned on by the active LED enabling control signal SS1. Subsequently, after a preset time interval td, a second rising edge of the clock signal CLK arrives at time t2, which makes the counting signal SCT increment from 00001 to 00010, thus making the LED enabling control signal SS2 from the enabling circuit 113 active (e.g., logic "1"). Such active LED enabling control signal SS2 turns on the LED enabling switch S2, thus activating the corresponding LED string SLED2. The above operation repeats until the last LED string SLED16 driven by the first LED driving integrated circuit IC1 is activated at time t16 when the counting signal SCT increments from 01111 to 10000 and the LED enabling control signal SS16 thus transits into an active state (e.g., logic "1").

Afterwards, when the next rising edge of the clock signal CLK arrives at time t17, the counting signal SCT increments from 10000 to 10001, which makes the downstream enabling control signal SSD from the enabling circuit 113 active (e.g., logic "1") and the inverted downstream enabling control signal SSD1 from the inverter INV non-active (e.g., logic "0"). As a result, the downstream enabling switch SD is turned off by the non-active inverted downstream enabling control signal SSD1, which makes the downstream enabling signal SOUT be at a high voltage level and be asserted (e.g., logic "1"). As the second LED driving integrated circuit IC2 receives the downstream enabling signal SOUT from the first LED driving integrated circuit IC1 as the enable signal SEN of the second LED driving integrated circuit IC2, the active downstream enabling signal SOUT from the first LED driving integrated circuit IC1 will be higher than the enable threshold signal STH1 (e.g., 2V) of the second LED driving integrated circuit IC2, thus, the second LED driving integrated circuit IC2 will repeat the operation of the first LED driving integrated circuit IC1 as elaborated above to activate the plurality of LED strings SLED1 SLEDi SLED16 driven by the second LED driving integrated circuit IC2.

As can be seen from the above operation of the LED driving system 600, the first LED driving integrated circuit IC1 can output the downstream enabling signal SOUT from the downstream enabling pin RDYOUT to the second LED driving integrated circuit IC2 to support the communication of the delay information between the time for the first LED driving integrated circuit IC1 to activate its last LED string SLED16 and the time for the second LED driving integrated circuit IC2 to activate its first LED string SLED1. This greatly simplifies the architecture of synchronizing the times for two adjacent LED driving integrated circuits to light on their LED strings. Especially, compared with the traditional differential interface solution in which all integrated circuits receive the enable signals from an MCU, the LED driving integrated circuit of the present invention will release the resource of the MCU.

It will be appreciated by persons skilled in the art that the present invention is not limited to what has been particularly shown and described herein above. Rather the scope of the present invention is defined by the appended claims and includes both combinations and sub-combinations of the various features described hereinabove as well as variations and modifications thereof which would occur to persons skilled in the art upon reading the foregoing description and which are not in the prior art.

What is claimed is:

1. A Light Emitting Diode (LED) driving integrated circuit for driving a plurality of LED strings, the LED driving integrated circuit comprising:

an enabling pin configured to receive an enable signal;

a plurality of LED enabling circuits having a one-to-one correspondence with the plurality of LED strings, wherein each LED enabling circuit is coupled to a corresponding LED string and is configured to activate the corresponding LED string when the LED enabling circuit is enabled;

a downstream enabling circuit configured to provide a downstream enabling signal, wherein the downstream enabling signal is asserted when the downstream enabling circuit is enabled;

a controlling circuit coupled to the enabling pin to receive the enable signal, wherein in response to the enable signal, the controlling circuit sequentially enables the plurality of LED enabling circuits and enables the downstream enabling circuit after the plurality of LED enabling circuits are enabled; and a downstream enabling pin coupled to the downstream enabling circuit and configured to output the downstream enabling signal.

2. The LED driving integrated circuit of claim 1, wherein the controlling circuit comprises:

an enable detecting circuit configured to receive the enable signal and an enable threshold signal and to generate a triggering signal based on comparing the enable signal with the enable threshold signal;

a counting circuit configured to generate a counting signal having a counting value, wherein the counting circuit is configured to increment the counting value every a preset time interval in response to the triggering signal; and an enabling circuit configured to generate a plurality of LED enabling control signals and a downstream enabling control signal based on the counting signal, wherein the plurality of LED enabling control signals have a one-to-one correspondence with the plurality of LED enabling circuits and each LED enabling control signal is configured to selectively enable or disable the corresponding LED enabling circuit, and the downstream enabling control signal is configured to selectively enable or disable the downstream enabling circuit.

3. The LED driving integrated circuit of claim 2, wherein the counting circuit is configured to receive a clock signal having a plurality of rising edges with every two successive rising edges having the preset time interval and to increment the counting value from an initial counting value to a preset maximum counting value in response to each rising edge of the clock signal.

4. The LED driving integrated circuit of claim 2, wherein the counting signal is of a digital form comprising at least one digit bit and the enabling circuit is configured to convert the counting signal of the digital form into the plurality of LED enabling control signals of an analog form and into the downstream enabling control signal of an analog form.

5. The LED driving integrated circuit of claim 1, wherein the downstream enabling circuit comprises a downstream enabling switch having a first terminal, a second terminal and a control terminal, wherein the first terminal of the downstream enabling switch is coupled to a supply voltage and is configured to provide the downstream enabling signal, and the second terminal of the downstream enabling switch is coupled to a reference ground, and wherein the downstream enabling switch is configured to receive a downstream enabling control signal at the control terminal and is selectively turned on or turned off in response to the downstream enabling control signal.

6. The LED driving integrated circuit of claim 1, wherein the controlling circuit is configured to sequentially enable the plurality of LED enabling circuits and the downstream enabling circuit at a plurality of enabling times with a preset time interval between every two successive enabling times.

7. The LED driving integrated circuit of claim 1, wherein each LED enabling circuit comprises an LED enabling switch having a first terminal coupled to the corresponding LED string, a second terminal coupled to a reference ground and a control terminal, and wherein the LED enabling switch is configured to receive an LED enabling control signal at the control terminal and the LED enabling switch is selectively turned on or turned off in response to the LED enabling control signal.

8. A Light Emitting Diode (LED) driving circuit for driving a plurality of LED strings, the LED driving integrated circuit comprising:

an enabling pin for receiving an enable signal;

a controlling circuit coupled to the first pin to receive the enable signal and configured to generate a plurality of LED enabling control signals and a downstream enabling control signal based on the enable signal;

a plurality of LED enabling circuits having a one-to-one correspondence with the plurality of LED strings and with the plurality of LED enabling control signals, wherein each LED enabling circuit is coupled to the controlling circuit to receive a corresponding LED enabling control signal, and wherein each LED enabling circuit is coupled to a corresponding LED string and is configured to activate or deactivate the corresponding LED string in response to the corresponding LED enabling control signal;

a downstream enabling switch coupled to the controlling circuit to receive the downstream enabling control signal and configured to provide a downstream enabling signal based on the downstream enabling control signal; and a downstream enabling pin coupled to the downstream enabling switch and configured to output the downstream enabling control signal.

9. The LED driving integrated circuit of claim 8, wherein the controlling circuit comprises:

an enable detecting circuit configured to receive the enable signal and an enable threshold signal and to generate a triggering signal based on comparing the enable signal with the enable threshold signal;

a counting circuit configured to generate a counting signal having a counting value, wherein the counting circuit is configured to increment the counting value every a preset time interval in response to an active state of the triggering signal; and a enabling circuit configured to generate a plurality of LED enabling control signals and a downstream enabling control signal based on the counting signal, wherein the plurality of LED enabling control signals have a one-to-one correspondence with the plurality of LED enabling circuits and each LED enabling control signal is configured to selectively enable or disable the corresponding LED enabling circuit, and the downstream enabling control signal is configured to selectively enable or disable the downstream enabling circuit.

10. The LED driving integrated circuit of claim 9, wherein the counting circuit is configured to receive a clock signal having a plurality of rising edges with every two successive rising edges having the preset time interval and to increment the counting value from an initial counting value to a preset maximum counting value in response to each rising edge of the clock signal.

11. The LED driving integrated circuit of claim 9, wherein the counting signal is of a digital form comprising at least one digit bit and the enabling circuit is configured to convert the counting signal of the digital form into the plurality of LED enabling control signals of an analog form and into the downstream enabling control signal of an analog form.

12. The LED driving integrated circuit of claim 8, wherein the downstream enabling switch has a first terminal, a second terminal and a control terminal, wherein the first terminal of the downstream enabling switch is coupled to a downstream enabling resistor to receive a supply voltage and is configured to provide the downstream enabling signal, and the second terminal of the downstream enabling switch is coupled to a reference ground, and wherein the downstream enabling switch is configured to receive the downstream enabling control signal at the control terminal and is selectively turned on or turned off in response to the downstream enabling control signal.

13. The LED driving integrated circuit of claim 8, wherein the controlling circuit is configured to sequentially enable the plurality of LED enabling circuits and the downstream enabling circuit at a plurality of enabling times with a preset time interval between every two successive enabling times.

14. The LED driving integrated circuit of claim 8, wherein each LED enabling circuit comprises an LED enabling switch having a first terminal coupled to the corresponding LED string, a second terminal coupled to a reference ground and a control terminal, and wherein the LED enabling switch is configured to receive an LED enabling control signal at the control terminal and the LED enabling switch is selectively turned on or turned off in response to the LED enabling control signal.

15. A Light Emitting Diode (LED) driving system, comprising:

a first LED driving integrated circuit and a second LED driving integrated circuit with each comprising an LED driving integrated circuit configured to drive a plurality of LED strings, wherein the LED driving integrated circuit comprises:

an enabling pin configured to receive an enable signal;

a plurality of LED enabling circuits having a one-to-one correspondence with the plurality of LED strings, wherein each LED enabling circuit is coupled to a corresponding LED string and is configured to activate the corresponding LED string when the LED enabling circuit is enabled;

a downstream enabling circuit configured to provide a downstream enabling signal, wherein the downstream enabling signal is asserted when the downstream enabling circuit is enabled;

a controlling circuit coupled to the enabling pin to receive the enable signal, wherein in response to the enable signal, the controlling circuit sequentially enables the plurality of LED enabling circuits and enables the downstream enabling circuit after the plurality of LED enabling circuits are enabled; and a downstream enabling pin coupled to the downstream enabling circuit and configured to output the downstream enabling signal;

wherein the enabling pin of the second LED driving integrated circuit is coupled to the downstream enabling pin of the first LED driving integrated circuit.

16. The LED driving system of claim 15, wherein the controlling circuit comprises:

an enable detecting circuit configured to receive the enable signal and an enable threshold signal and to generate a triggering signal based on comparing the enable signal with the enable threshold signal;

a counting circuit configured to generate a counting signal having a counting value, wherein the counting circuit is configured to increment the counting value every a preset time interval in response to an active state of the triggering signal; and a controlling circuit configured to generate a plurality of LED enabling control signals and a downstream enabling control signal based on the counting signal, wherein the plurality of LED enabling control signals have a one-to-one correspondence with the plurality of LED enabling circuits and each LED enabling control signal is configured to selectively enable or disable the corresponding LED enabling circuit, and the downstream enabling control signal is configured to selectively enable or disable the downstream enabling circuit.

17. The LED driving system of claim 16, wherein the counting circuit is configured to receive a clock signal having a plurality of rising edges with every two successive rising edges having the preset time interval and to increment the counting value from an initial counting value to a preset maximum counting value in response to each rising edge of the clock signal.

18. The LED driving system of claim 16, wherein the counting signal is of a digital form comprising at least one digit bit and the enabling circuit is configured to convert the counting signal of the digital form into the plurality of LED enabling control signals of an analog form and into the downstream enabling control signal of an analog form.

19. The LED driving system of claim 15, wherein the downstream enabling switch has a first terminal, a second terminal and a control terminal, wherein the first terminal of the downstream enabling switch is coupled to a downstream enabling resistor to receive a supply voltage and is configured to provide the downstream enabling signal, and the second terminal of the downstream enabling switch is coupled to a reference ground, and wherein the downstream enabling switch is configured to receive the downstream enabling control signal at the control terminal and is selectively turned on or turned off in response to the downstream enabling control signal.

20. The LED driving system of claim 15, wherein the controlling circuit is configured to sequentially enable the plurality of LED enabling circuits and the downstream enabling circuit at a plurality of enabling times with a preset time interval between every two successive enabling times.

* * * * *